US006059881A

United States Patent [19]

Nomura et al.

[11] Patent Number: 6,059,881

[45] Date of Patent: May 9, 2000

[54] COATER BLADES AND THEIR MANUFACTURING METHODS

[75] Inventors: Hirotoshi Nomura; Keiji Nakayama; Hisakazu Takagishi; Tokumi Ikeda, all of Osaka, Japan

[73] Assignee: Nomura Techno Research Kabushiki Kaisha, Osaka, Japan

[21] Appl. No.: 08/101,999

[22] Filed: Aug. 4, 1993

[30] Foreign Application Priority Data

Aug. 7, 1992 [JP] Japan ..... 4-211417

[51] Int. Cl.[7] ..... B05C 1/00

[52] U.S. Cl. ..... 118/126; 118/203; 118/261; 118/413

[58] Field of Search ..... 118/261, 413, 118/203, 126; 162/281; 15/256.51, 256.5

[56] References Cited

U.S. PATENT DOCUMENTS

| | | | |
|---|---|---|---|
| 3,908,590 | 9/1975 | Quint | 118/122 |
| 4,802,928 | 2/1989 | Dunlap | 162/281 |
| 5,119,755 | 6/1992 | Beisswanger | 118/261 |
| 5,168,806 | 12/1992 | Reder et al. | 118/261 |
| 5,178,065 | 1/1993 | Reder et al. | 118/261 |
| 5,224,995 | 7/1993 | Shibamoto | 118/203 |

FOREIGN PATENT DOCUMENTS

| | | |
|---|---|---|
| 5988995 | 5/1984 | Japan . |

*Primary Examiner*—Laura Edwards
*Attorney, Agent, or Firm*—Flynn, Thiel, Boutell & Tanis, P.C.

[57] ABSTRACT

A coater blade and backing roll combination contains a coater blade having an elastic steel blade with a wear-resistant coating formed thereon. The wear-resistant coating has a hardness greater than that of the elastic steel blade and is provided on an edge of the blade to define a coater surface for contacting with a moving surface of coated paper on the backing roll. The backing roll has a concave outer surface having a curvature corresponding to a quadratic equation and the coater surface has a concave curvature corresponding to the quadratic equation.

3 Claims, 4 Drawing Sheets

COATER BLADES AND THEIR MANUFACTURING METHODS

BACKGROUND OF THE INVENTION

1. Field of the Invention

This invention concerns a coater blade for a coating process, its manufacturing method and its use in a coating process and in the manufacture of many kinds of coated paper, such as coated paper for printing, pressure sensible copy paper, or pressure sensible recording paper, by coating a aqueous emulsion consisting of pigments as the main into the paper.

2. Description of the Prior Art

Up to now, the coater blades used for the coating processes for manufacturing many kinds of coated paper are made up with elastic spring steels (SK-4 or SK-5) or SUS410, which were hardened by quenching and refined in a range of 0.3–0.8 mm in depth, 50–150 mm in width and 1500–7000 mm in length. The coater blades are divided into two types; the bevel type blade, which is used by pressing its pointed end, which has an oblique cut, against the coating paper and the other is the bent-type blade, which is used by pressing the bottom of the pointed end against the coating paper. Though they are used properly depending on the required quantities of coating material, the type of paper used, and the required quality of the product by the users, it seems to be the actual situation that the life-time of the blades has been as short as 4 to 12 hours, or 8 hours on the average, during which the blades wore away or suffered damage, because the blade is scraped continuously with coating paper moving at a high speed, or with an aqueous emulsion.

Therefore, as was shown, in Japan patent Publication No. 1984-88995 as an example, it has been proposed to maintain the stability of the operation in the manufacturing process of the coated paper by decreasing the frequency of exchange of the blade by increasing its life. This has been accomplished by providing a grinding finish after coating by a thermal sprayer with ceramic such as alumina, alumina-titania, or chromium (III) oxide on a part of the surface of the blade. Although this ceramic coated blade made by the thermal spray method could achieve a life of 3–4 times longer after it has been properly used, compared with a usual coater blade made of spring steel, there are some cases that the coater blades are not suitable for use because of coating speckles, depending on the adapted coating materials. The cause may be attributed on one hand to the grinding processing at the contact position of the blade to the coating paper and, on the other hand, to the difficulty in fitting the coater blade to the bending deformation of the backing roll by the better abrasion-resistance of the coating materials. On the other hand, in the case of a conventional coater blade made of non-coated steel, despite its contact position to the coating paper being processed straight by grinding, the reason why it can be used adjustably for every coater is attributed to its short life, in other word, its low resistance to abrasion, which makes the coater blade installed in the coater head wear rapidly to fit along the upper curvature of the backing roll.

As for the other problem, because the coater blade described in Japan Patent Publication No. 1984-88995 is formed in a straight camber, the use of this is almost limited to one in which the backing roll has a slight curvature and, even in this case, it is necessary to install the blade in the coating machine at a high accuracy or there is a tendency to produce a comparatively large amount of loss of the initial coating paper by the occurrence of coating streaks until the blade has adapted to the backing roll. Moreover, in the case of a coating of a non-ceramic material such as hard metals, for example, chromium plating, nickel-phospor alloy plating, and nickel-boron alloy plating, the coater blade has the same tendencies as those of the ceramic-coated blade as long as it is formed in a straight camber.

SUMMARY OF THE INVENTION

This invention has been made to improve the above mentioned defects of the previously used coater blade. The purpose of this invention is to manufacture a longer life coater blade made of elastic steel, which is coated with harder materials than steel at least at and near the area of its contact point against the coating paper, and to make it possible to use the coater blade for every backing roll of blade coater by making its initial fit faster than usual.

As the result of the efforts to resolve the above defects, we found that it is efficient to decide the value of the opening camber at the contact point of the coater blade to the coating paper based on the upward bending amount of the backing roll of the coating obtained when the roll is pressed by the coater blade and further to adjust it to the quadratic equation of the curvature of the backing roll. Using this method, it is possible to decrease the initial unavoidable loss of the coating paper by coating streaks when the blade is covered with a ceramic material or hard wear-resistant plating metal and, at the same time, to present a coater blade with a longer life. In FIG. 1, the state of the coater blade 1, which is formed to have an opening camber according to a quadratic equation for the upward curvature of the backing roll when the roll is pressed by the blade, is shown. Further, coater blades 1 of the bent-type and the bevel-type pressed to the backing roll 2 are shown in FIG. 2 and FIG. 3, respectively.

The actual methods of providing an opening camber on a coater blade coated with a coating material having an excellent hardness and abrasion-resistance are described below.

1) In the case of coating with metals, metallic and non-metallic oxides, carbonized, nitrided, or boronized materials by the thermal spray method, the plasma-thermal and the oxy-fuel spraying methods etc. are used, but, the surface after coating becomes coarse (rough) and can not be used directly as the coater blade. As such, a polishing process is essential. Therefore, we should provide the opening camber at the of polishing. In the case of surface coating by the dry-plating method, such as ion-plating with carbonized and nitrided materials on the surface of the coater blade, as it is difficult to provide a thick coat on the surface, as opposed to the thermal spray method, it is better to provide the opening camber on the steel in its raw state before plating.

2) In the case of plating with chromium, nickel-phosphorous, nickel-boron alloy—or a dispersion strengthened alloy, which are formed from the above alloys with metallic or non-metallic carbides, oxides, or boronides, as coating materials, the coating, being different from a dry plating method, such as ion-plating, can be done without concern for its thickness and, if proper conditions are selected, does not provide a rough surface as is seen in the case of the thermal spray method, which is not suitable for direct use. Therefore, in this case, the opening camber can be provided in the coater blade either before or after the plating. But in the case of the use of electrolytic plating method, such as chromium plating, which has a strong tendency to vary the thickness of the plating in proportion to the intensity of the electric current applied, the opening camber can be formed by adjusting the form of the electrode and by varying the distance between the electrode and the coater blade to be plated, both being essential conditions for electric plating.

The necessary coating area with the above coating materials on the coater blade is enough to be 5–30 mm wide from the contact line to the coating paper, namely, from a pointed end of the coater blade. The coating needs to be 5–300 $\mu$m in thickness, in which a range of 10–250 $\mu$m is most satisfactory. Further, according to the experimental results for practical use, it was found that when the value Cm/Df was adjusted to be 0.4–2.2, where Cm equals to a value of opening camber built in the coater blade and Df equals to an upper-curve value when the backing roll has been pressed up, the blade could have the longest life and the initial loss of the coating paper could be decreased.

DETAILED DESCRIPTION OF THE INVENTION

As already having been explained above, this invention is directed to a coater blade made of flexible steel and coated, at least near the contact point with the coating paper, with a coating material harder than steel, to give it a longer life, a method to make the initial fit faster and to make possible its use in every backing roll of the blade coater.

In the precise investigation of used coater blades made of the usual coated steel or those removed from the coating machine owing to the occurrence of unevenness of coating or streaks, it was found that the abrasion had a crown shape, or a swelling shape, in which the coater blade has a higher abrasion at both sides than the middle part of the contact point of the blade to the coating paper. After repeated examination based on the amount of wear, it was found that the backing roll, pressed to the coater blade through the coating paper, is bent upwardly by the pressure. Therefore, the blade wears according to a quadratic equation for a convex curve. This situation may be explained below precisely using given figures.

Figure 1:
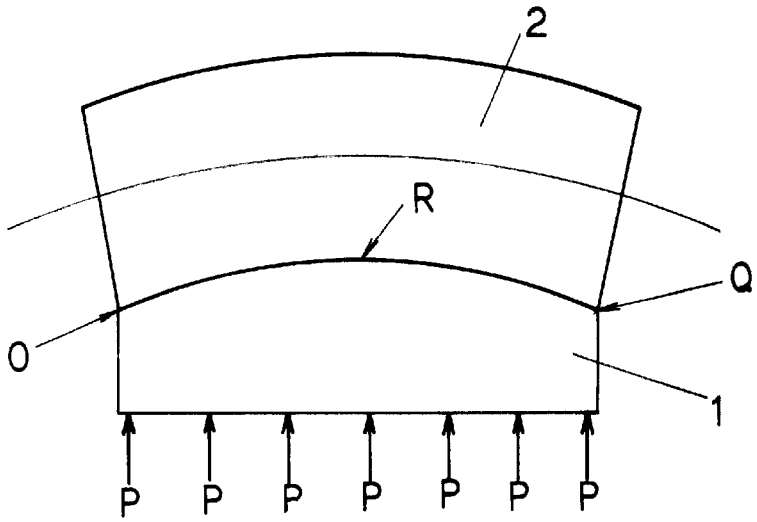
FIG. 1 A front view showing the pressing state with a coater blade of this invention.
Figure 2:
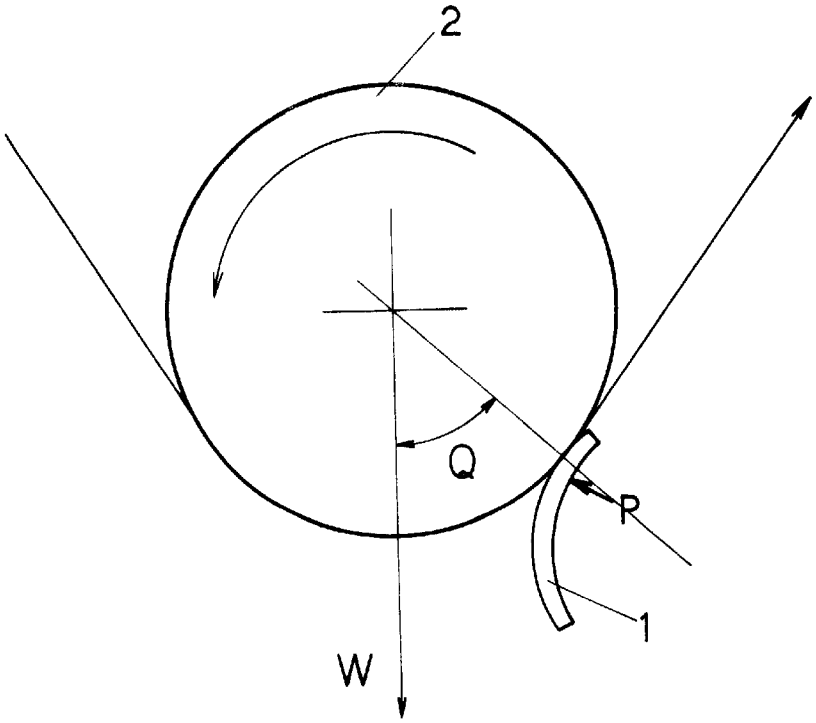
FIG. 2 A side view showing the processing state with a coater blade of the bent-type.
Figure 3:
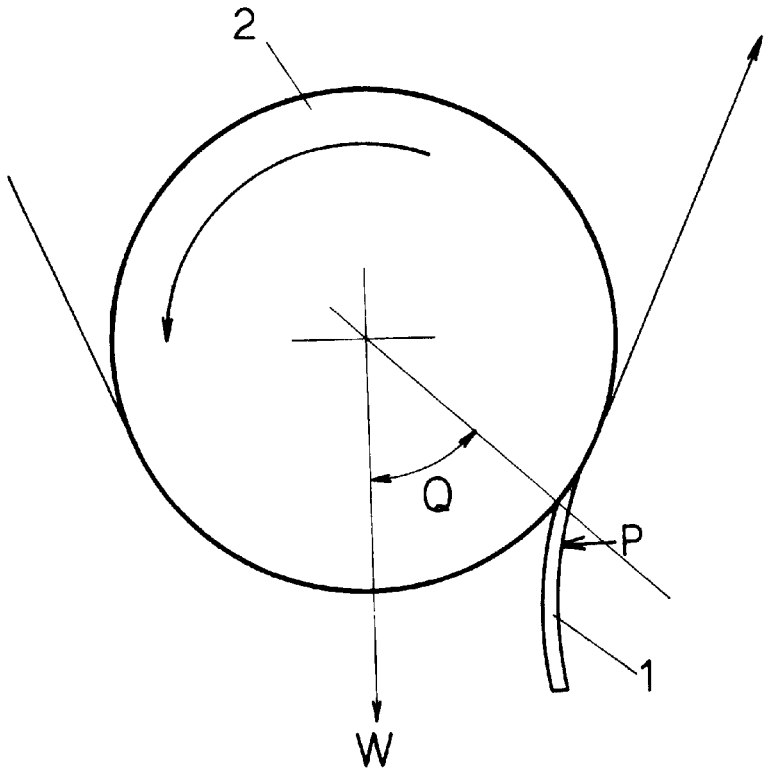
FIG. 3 A side view showing the processing state with a coater blade of the bevel type.
Figure 4:
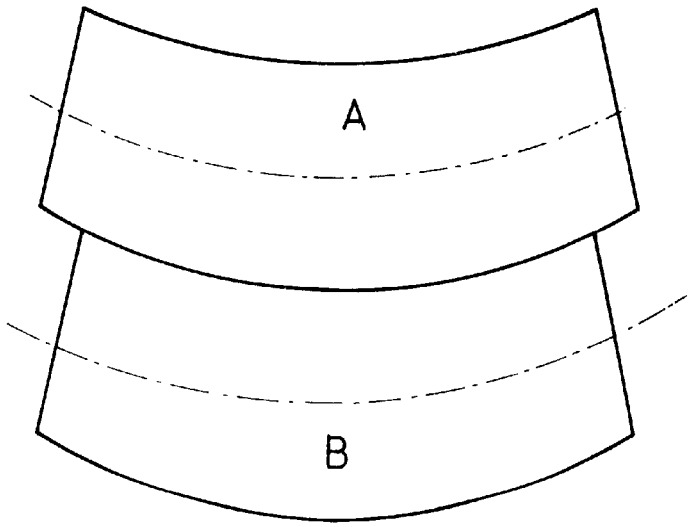
FIG. 4 An illustrating figure of the setting state of the two rolls (A & B) making use of this invention.

FIG. 4 illustrates the installed state of two rolls (A & B) in the coating machine and both rolls are in parallel bending whether the machine is operating or not.

Figure 5:
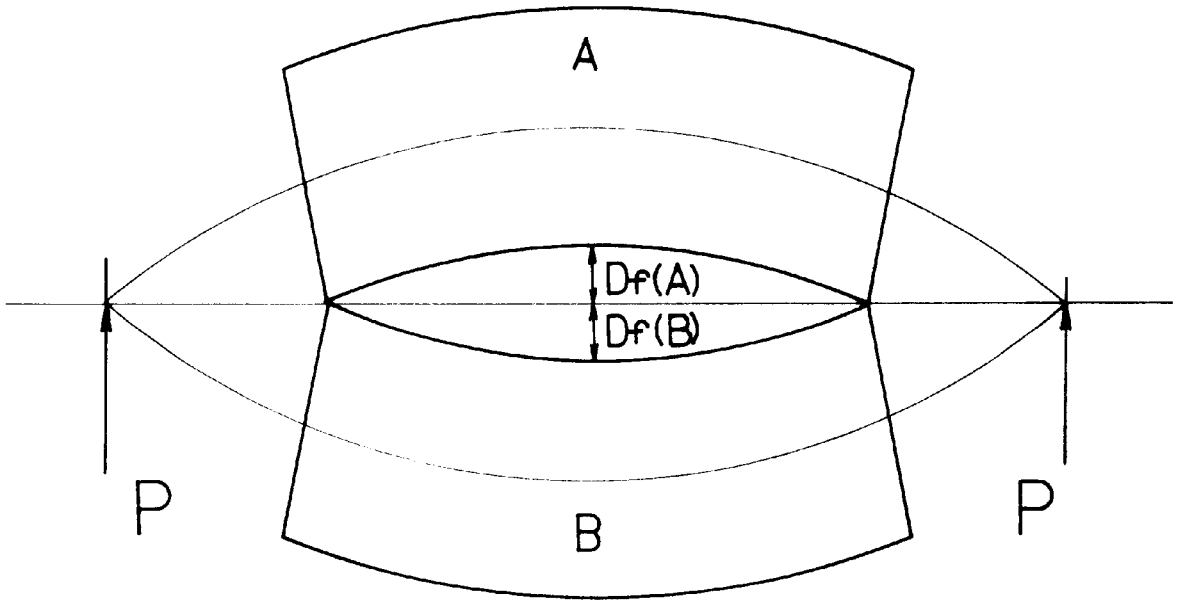
FIG. 5 An illustrating figure of a state of the two rolls (A & B) pressed from B side making use of this invention.

FIG. 5 illustrates the two rolls (A & B) rotating in which roll A is pressed by a weight P. In this state, the roll A would have a concave curvature and the roll B would also have a concave curvature.

Figure 6:
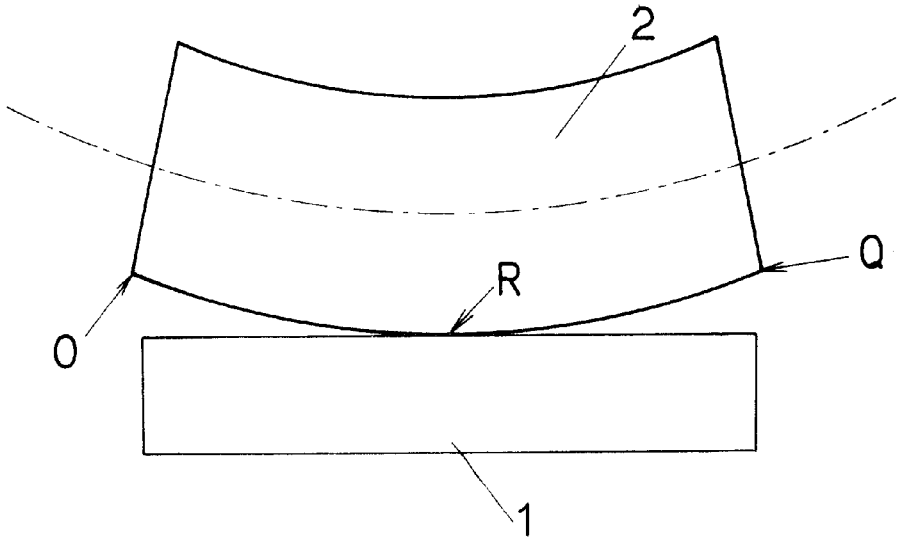
FIG. 6 An illustrating figure of a state of the coater blade with the straight camber 1 of this invention in contact with the rotating roll 2.
Figure 7:
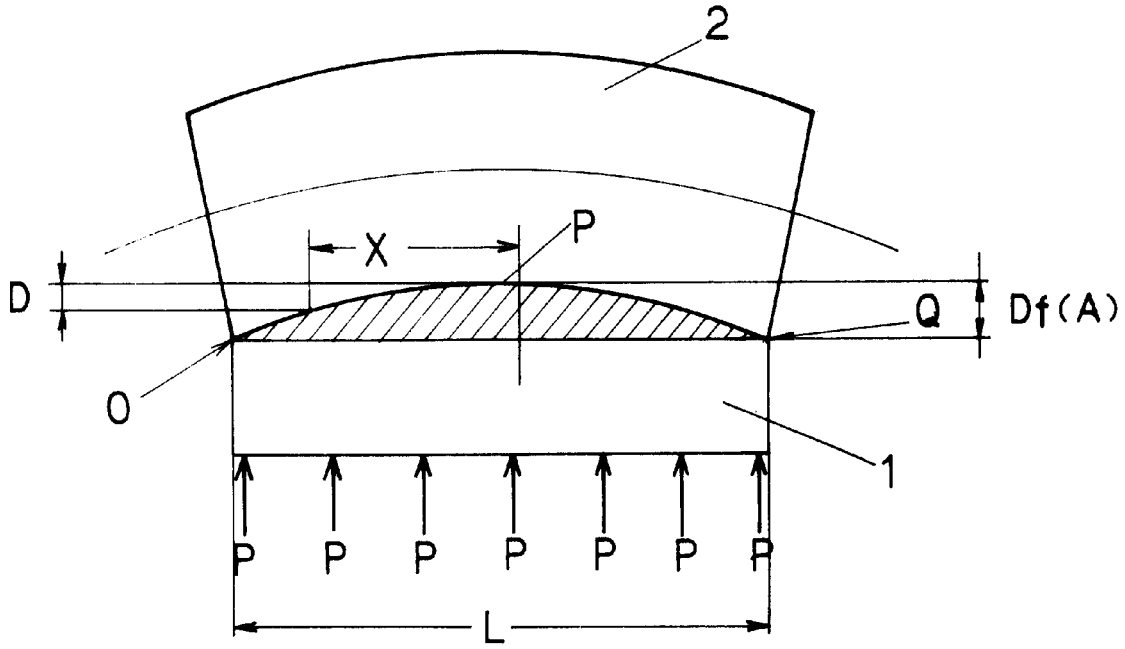
FIG. 7 An illustrating figure of a state of the blade with the straight camber 1 of this invention pressed to the rotating roll 2.
Figure 8:
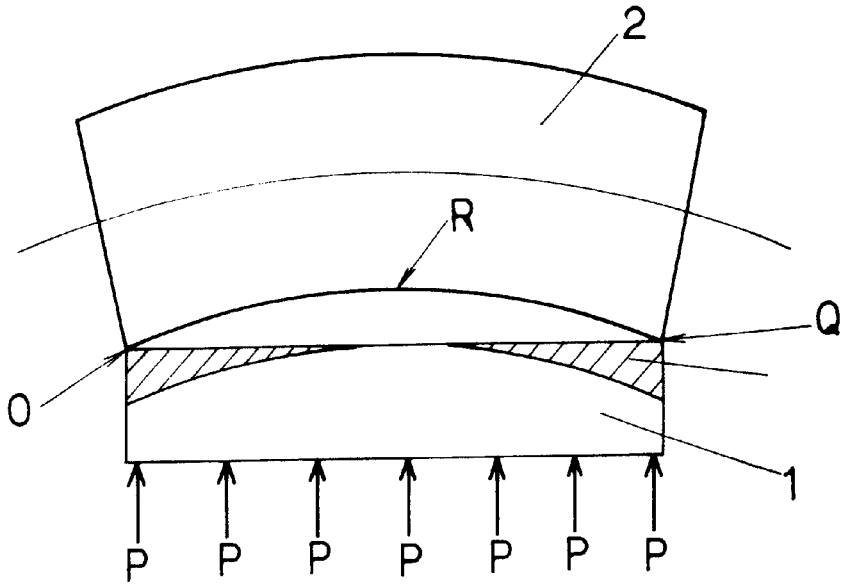
FIG. 8 An illustrating figure of the selective wearing part of the blade with the straight camber 1 of this invention after processing.

Now, if the curvature value of the roll A is expressed by Df(A), the equation [0012] is obtained;

$$P=(N\times L)-W\cos\theta$$

$$Df(A)=K\times P/EI \qquad [0012]$$

where P(kg) is the pressure against the roll A, L(cm) is the surface length of the roll A, E is the Young's modulus (ratio) (kg/mm2) for the roll A, I is the cross section-secondary moment of the roll A (kg/mm4), W is the weight of the roll A (kg), N is the nip pressure against the roll A (kg/cm), and K is a constant defined by the size of the roll A. When these equations are applied to the backing roll of a blade coater and the coater blade, FIG. 6 and FIG. 7 are obtained. That is to say, FIG. 6 shows the unpressed state of the rotating backing roll 2 keeping contact with the coater blade 1 of an usual straight camber. FIG. 7 shows the pressed state under a constant pressure under the same setting as FIG. 6. Under these conditions, because the backing roll 2 may have a concave curve which forms a crevice provided between a curve and the straight camber of the coater blade, shown by the oblique lines in FIG. 7, which makes contact inefficient and streaks of coating may be produced. In this case, the quadratic curve (D) of the concave curve is expressed in the next formula;

$$D=Df(A)\times X2/(L/2)2$$

Therefore, it would be desirable to grind the coater blade 1 to have a straight camber at both sides of the blade 1 so as to fit to the oblique curve D expressing the concave curve of the backing roll 2. This grinded part corresponds to the worn part of the blade without any production especially during the initial operation. By doing this grinding, the coater blade is able fit to the backing roll in full length from the start of the operation. Therefore the initial loss of the coating paper caused by streaks is avoided in large measure.

Embodiment

The executed examples of this invention are shown and explained below. As shown in Table 1, SK-5 was used as the steel material for the reference and the testing samples are made by chromium plating with the use of electrolytic plating, alumina coating by the thermal spray method, and nitriding titanium coating by the ion-plating method, all on this SK-5 steel. Each testing blade is prepared with both a straight camber and an opening camber.

TABLE 1

| Coating material | Coating method | Thickness of coating | Hardness (Hv) | Shape of camber | Method of camber formatiom |
|---|---|---|---|---|---|
| none (SK-5) (reference) | — | — | 530 | Straight | polishing |
| Chromium plating | Electrolytic plating | 50 μm | 1100 | Straight | polishing before plating |
| Chromium plating | Electrolytic plating | 50 μm | 1050 | Opening camber (15 μm) | electrolytic plating |
| Alumina | Thermal spray | 200 μm | 850 | Straight | polishing |
| Alumina | Thermal spray | 200 μm | 820 | Opening camber (18 μm) | polishing |
| Nitrided titanium | Ion plating | 10 μm | 2800 | Straight | polishing before plating |
| Nitrided titanium | Ion plating | 10 μm | 2800 | Opening camber (15 μm) | polishing before plating |

TABLE 2

| Coating Material | Life time (h) | Shape of camber | Special description |
|---|---|---|---|
| none (SK-5) (reference) | 8 | Straight | The loss of coating paper by the initial coating streaks is defined as A |
| Chromium plating | 0 | Straight | Unusable by the occurrence of partial coating streaks |
| Chromium plating | 96 | Opening camber | The loss of coating paper by the initial coating streaks was ½ A |
| Alumina | 35 | Straight | The loss of coating paper by the initial coating streaks was 3A |
| Alumina | 83 | Opening camber | The loss of coating paper by the initial coating streaks was ⅓ A |
| Nitrided titanium | 0 | Straight | Unusable due to the occurrence of coating streaks on the whole surface |
| Nitrided titanium | 45 | Opening camber | The loss of coating paper by the initial coating streaks was A |

The roughness of the polishing surface of each blade was in a range of 1–3 uRz. Each coater blade, made in the bevel type of 100 mm wide, 3,730 mm in length, 0.635 mm in depth, and 200 of angle at the point end, was applied to the backing roll of 960 mm in diameter and 3,770 mm in length. In this circumstance, keeping the next values constant, that is, the nip-pressure of the coater blade equal to ca. 14 Kg/cm, the convex curvature value ca. 16 μm, the coating speed 1,000 m/min, the amount of the coated material 15 g/m2/one side, when coated with the coating materials mainly composed of calcium carbonate, clay, or latex, the results obtained are shown in Table 2.

From Table 2, it is clear that the use of a coater blade processed so as to have an opening camber value corresponding to the concave curvature value of the backing roll caused by a pressure of coater blade and to have the similar form at the pointing end as a quadratic curve expressing the concave curvature of the backing roll, makes the loss of the coating paper produced by initial coating unevenness decreased and hence makes continuous and stable coating possible. The reason why there are difference in the results between the use of the blades of chromium plating and alumina coating, in both cases processed in straight camber and opening camber, is attributed to the difference in the wear-resisting property, depending on their hardness of the coating materials. That is, to the difference in the initial adaptability of the blade. These phenomena are also observed in the case of chromium and nitrided titanium platings. Further, although the above explanation is done only with the desirable cases as examples, this invention is not limited to the above applications.

As mentioned above, using this invention, because the coater blade is given a longer life by coating the harder coating materials at the contact point to the coating paper and processed in a similar form to the surface as those after initial wear to fit to the curvature of the backing roll to which the blade is pressed, it is easily adaptable to the backing roll from the start of the operation, hence a part of the coating streaks is decreased and the initial loss of the coating paper can be effectively reduced.

The present invention, in which the maximum value of the opening camber was set up to the range of 0.4–2.2 times of the upward curvature value of the backing roll obtained by pressing with a coater blade, hence the coater blade had a longer life and was effective in reducing the initial loss of the paper, as was experimentally confirmed.

Further, this invention, in which the surface of the coater blade is formed by polishing the surface after the thermal spraying of the harder coating materials at the contact point to the coating paper, is effective in doing both polishing after thermal spraying and shape-forming in one process and, therefore, is effective in decreasing the number of steps in the manufacturing process.

Furthermore, this invention has an advantage of either being able to omit the polishing step after electrolytic plating or to shorten (cut down) the polishing time, because the opening camber is formed by adjusting the intensity of the electric current so as to get a higher deposit toward the middle point of the coater blade than at both sides, and the highest at the middle point, when the coater blade is electrically plated with harder materials at and near the contact point to the coating paper.

What is claimed is:

1. A coater blade and backing roll combination, said coater blade comprising an elastic steel blade having a wear-resistant coating formed thereon, said wear-resistant coating having a hardness greater than that of said elastic steel blade and is provided on an edge of said blade to define a coater surface for contacting with a moving surface of coated paper on said backing roll, said backing roll having a concave outer surface having a curvature and said coater surface having a convex curvature corresponding to the quadratic equation which defines the curvature of said backing roll outer surface.

2. The combination of claim 1, wherein said wear-resistant coating is a ceramic coating.

3. The combination of claim 1, wherein said wear-resistant coating is a metallic coating.

* * * * *